US011326563B2

(12) United States Patent
Yoshigasaki et al.

(10) Patent No.: US 11,326,563 B2
(45) Date of Patent: May 10, 2022

(54) OUTBOARD ENGINE COVER STRUCTURE

(71) Applicant: HONDA MOTOR CO., LTD., Tokyo (JP)

(72) Inventors: Tsuyoshi Yoshigasaki, Wako (JP); Yoshihiro Harada, Wako (JP); Yuki Hase, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/202,585

(22) Filed: Mar. 16, 2021

(65) Prior Publication Data

US 2021/0293209 A1 Sep. 23, 2021

(30) Foreign Application Priority Data

Mar. 19, 2020 (JP) ..... JP2020-049816

(51) Int. Cl.
*F02M 35/10* (2006.01)
*B63H 20/32* (2006.01)

(52) U.S. Cl.
CPC ..... *F02M 35/1015* (2013.01); *B63H 20/32* (2013.01)

(58) Field of Classification Search
CPC ..... F02M 35/10; F02M 35/10006; F02M 35/10268; F02M 35/10288; F02M 35/165; F02M 35/167; F02M 35/168; F01P 1/00; F01P 1/06; F01P 7/02; F01P 2050/02; F01P 2050/12; F01P 2050/04; B63H 20/32; F02B 61/04; F02B 61/045
See application file for complete search history.

(56) References Cited

U.S. PATENT DOCUMENTS 6,439,938 B1 * 8/2002 Katayama ..... F01L 1/02 440/77
6,497,595 B2 * 12/2002 Nemoto ..... F02B 75/22 440/77
8,707,915 B2 * 4/2014 Inaba ..... F02M 35/168 123/41.54
8,851,945 B2 * 10/2014 Harada ..... F02B 61/045 440/77
9,017,122 B2 * 4/2015 Harada ..... F02M 35/1244 440/88 A (Continued)

FOREIGN PATENT DOCUMENTS

JP 2013-23119 A 2/2013

*Primary Examiner* — Grant Moubry
(74) *Attorney, Agent, or Firm* — Westerman, Hattori, Daniels & Adrian, LLP

(57) ABSTRACT

An outboard engine cover structure that covers an outboard engine and includes an inner cover on an inside and an outer cover on an outside. The structure includes a flow space for air formed between the inner and outer covers, an intake formed in a lower portion of the outer cover and configured to take in outer air to the flow space, a communication port formed in the inner cover in a position above the intake, and configured to cause an inner space of the inner cover accommodating the outboard engine to communicate with the flow space, first ribs arranged between the intake and the communication port in the flow space; and second ribs arranged between the intake and the communication port and positioned closer to the communication port than the first ribs in the flow space.

7 Claims, 5 Drawing Sheets

(56) References Cited

U.S. PATENT DOCUMENTS

2004/0018785 A1* 1/2004 Yasuda ..... F02B 61/045
440/77
2018/0363604 A1* 12/2018 Miyashita ..... B60K 13/02

* cited by examiner

OUTBOARD ENGINE COVER STRUCTURE

CROSS-REFERENCE TO RELATED APPLICATION(S)

This application claims priority to and the benefit of Japanese Patent Application No. 2020-049816 filed on Mar. 19, 2020, the entire disclosure of which is incorporated herein by reference.

BACKGROUND OF THE INVENTION

Field of the Invention

The present invention relates to an outboard engine cover structure.

Description of the Related Art

Since an outboard engine is used on the water surface, it is necessary to prevent water intrusion, rust, and salt damage. Japanese Patent Laid-Open No. 2013-23119 discloses a structure in which an outboard engine is covered with a cover.

When taking in air for an engine or taking in air for cooling, it is desirable to sufficiently remove water and the like. The related art still has room for improvement in this respect.

SUMMARY OF THE INVENTION

It is an object of the present invention to provide a technique capable of effectively removing water and the like to be taken in to an outboard engine.

According to an aspect of the present invention, there is provided an outboard engine cover structure that covers an outboard engine and includes an inner cover on an inside and an outer cover on an outside, comprising: a flow space for air formed between the inner cover and the outer cover; an intake formed in a lower portion of the outer cover and configured to take in outer air to the flow space; a communication port formed in the inner cover in a position above the intake, and configured to cause an inner space of the inner cover accommodating the outboard engine to communicate with the flow space; first ribs arranged between the intake and the communication port in the flow space; and second ribs arranged between the intake and the communication port and positioned closer to the communication port than the first ribs in the flow space.

Further features of the present invention will become apparent from the following description of exemplary embodiments (with reference to the attached drawings).

DESCRIPTION OF THE EMBODIMENTS

Figure 1:
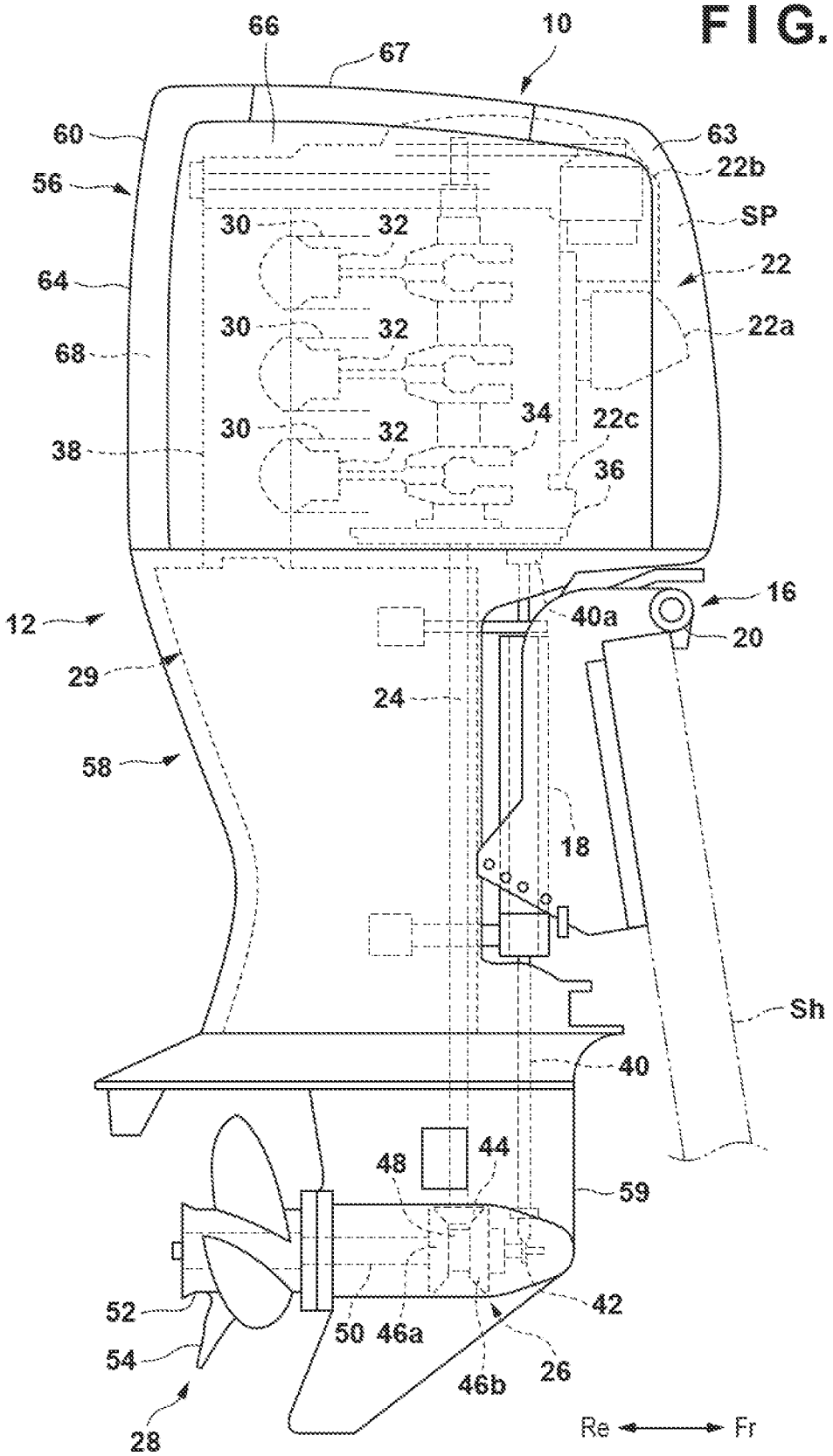
FIG. 1 is a side view showing the overall structure of an outboard engine.

Hereinafter, embodiments will be described in detail with reference to the attached drawings. Note that the following embodiments are not intended to limit the scope of the claimed invention, and limitation is not made an invention that requires all combinations of features described in the embodiments. Two or more of the multiple features described in the embodiments may be combined as appropriate. Furthermore, the same reference numerals are given to the same or similar configurations, and redundant description thereof is omitted.

FIG. 1 is a side view of an outboard engine 10 using a cover 12 having a structure according to an embodiment of the present invention. The outboard engine 10 is attached to a ship hull Sh as a power source of a small ship or the like, and propels the ship hull Sh by being driven by a user's operation. In FIG. 1. Fr indicates the front side in the front-and-rear direction of the outboard engine 10, and Re indicates the rear side. When mentioning the direction of the outboard engine 10, this direction means a direction when the outboard engine 10 is mounted on the ship hull Sh (particularly a direction in the posture when the outboard engine 10 is operated with a crank shaft 34 pointing in the vertical direction as shown in FIG. 1).

The outboard engine 10 is fixed to the ship hull Sh via an attaching mechanism 16. The attaching mechanism 16 can swing the outboard engine 10 around a swivel shaft 18, and can swing the outboard engine 10 clockwise or counterclockwise around a tilt shaft 20. Fins 54 are positioned underwater when the outboard engine 10 is in the posture shown in FIG. 1.

The cover 12 has an engine 22, a drive shaft 24, a gear mechanism 26, and a propeller mechanism 28 inside. Also, below the engine 22, the outboard engine 10 has an exhaust system (not shown) for causing the exhaust gas of the engine 22 to flow, and a cooling structure 29 for cooling the engine 22 and the exhaust gas.

The cooling structure 29 is formed by, for example, stacking a plurality of cases inside the cover 12. The cooling structure 29 can have a silencing function that is implemented by causing cooling water (seawater or fresh water obtained from outside the outboard engine 10) to flow around the exhaust pipe (not shown) of the exhaust gas.

The engine 22 is a multicylinder engine (for example, a V-type engine) including a plurality of cylinders 30 along the vertical direction of the outboard engine 10. The engine 22 has a structure in which the axis of each cylinder 30 is arranged sideways (almost horizontally). The crank shaft 34 to be coupled with a connecting rod 32 of each cylinder 30 is extended in the vertical direction. Water jackets are formed for a cylinder block 36 and a cylinder head 38 of the engine 22, and can cool these members by using the cooling water of the cooling structure 29.

The crank shaft 34 is coupled with the upper end of the drive shaft 24. The drive shaft 24 is extended in the vertical direction inside the cover 12, and rotated together with the rotation of the crank shaft 34. The lower end of the drive shaft 24 is coupled with the gear mechanism 26. When an operation shaft 40 is operated, the gear mechanism 26 rotates the propeller mechanism 28 by switching the driving forces of the engine 22, thereby moving the ship hull Sh forward or backward. The operation shaft 40 is rotated by, for example, a shift actuator 40*a* that is driven in accordance with a user's shift operation.

When the operation shaft 40 rotates, the gear mechanism 26 moves a shift slider 42 forward or backward in the axial direction of a propeller shaft 50. Consequently, the shift slider 42 moves a dog clutch 48 between a forward driven bevel gear 46*a* and a backward driven bevel gear 46*b* that mesh with a driving bevel gear 44 coupled to the drive shaft 24. When the tooth surface of the dog clutch 48 meshes with one of the inside tooth surface of the forward driven bevel gear 46*a* and the inside tooth surface of the backward driven bevel gear 46*b*, the driving force of the engine 22 is transmitted to the propeller mechanism 28 via the dog clutch 48 and the propeller shaft 50.

The propeller mechanism 28 includes the cylindrical propeller shaft 50 into which the shift slider 42 is inserted, a cylindrical member 52 coupled with the outside of the propeller shaft 50 in the radial direction, and the plurality of fins 54 coupled with the outer circumferential surface of the cylindrical member 52. The propeller mechanism 28 rotates the fins 54 clockwise or counterclockwise around the propeller shaft 50 rotated by the gear mechanism 26, thereby moving the ship hull Sh forward or backward.

The cover 12 includes an upper cover 56 mainly covering the engine 22 positioned in the upper portion of the outboard engine 10, and a lower cover 58 mainly covering members below the engine 22. For example, the upper cover 56 and the lower cover 58 are fixed to a mount frame (not shown) for mounting the engine 22, and divided from the mount frame as the boundary. A gear case 59 forming the gear mechanism 26 is coupled with the lower end of the lower cover 58.

Figure 2:
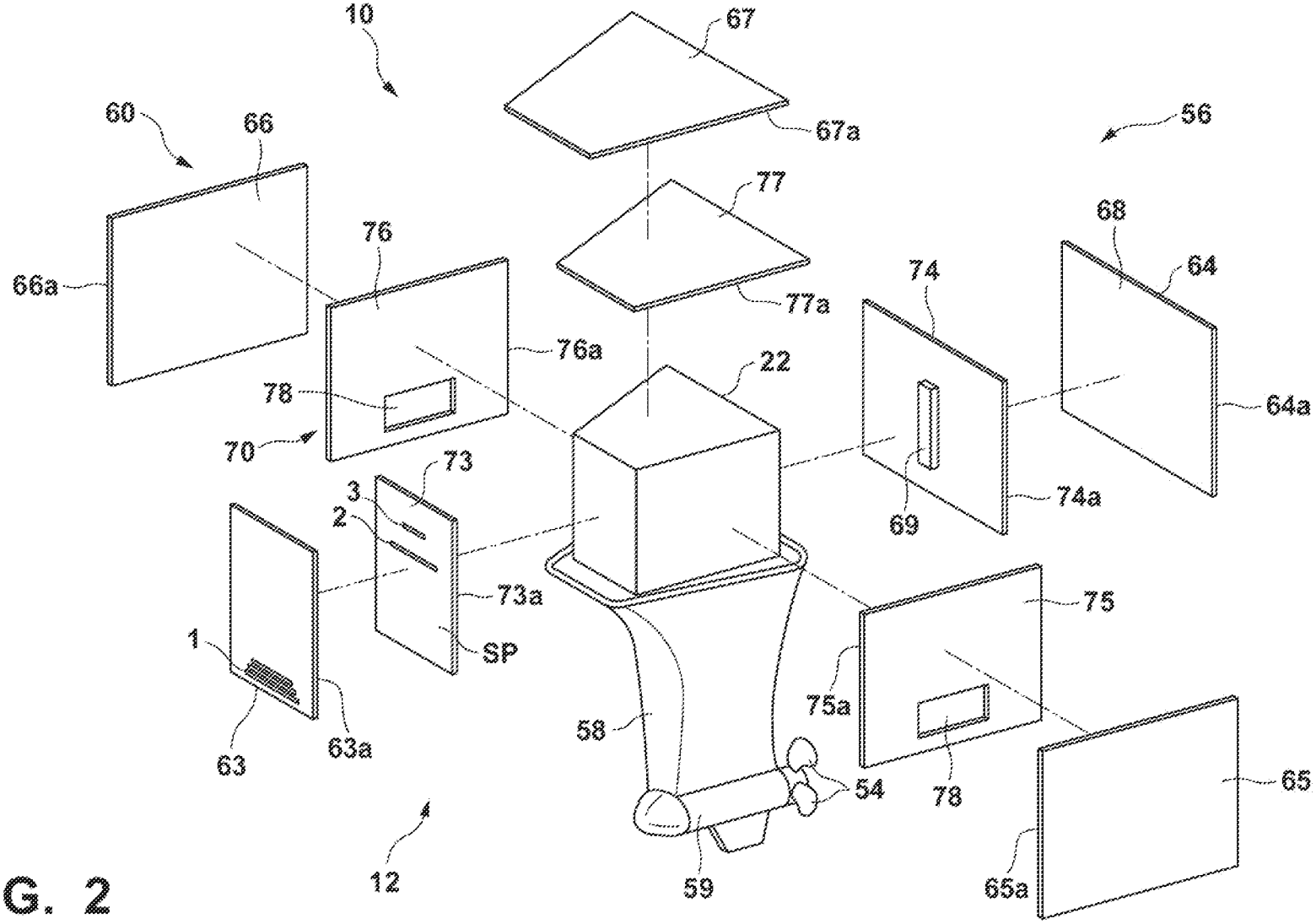
FIG. 2 is an exploded perspective view schematically showing the structures of an inner cover and an outer cover.

The upper cover 56 is a hollow body covering the front and rear sides, the left and right sides, and the upper and lower sides of the engine 22, and has a double structure including an outer cover 60 on the outside and an inner cover 70 on the inside. The outer cover 60 may have a dividable structure formed by a plurality of members, and the inner cover 70 also has a dividable structure formed by a plurality of members. FIG. 2 is an exploded perspective view schematically showing members of the inner cover 70 and the outer cover 60. In this embodiment, the inner cover 70 and the outer cover 60 each form a hollow body covering the engine 22.

The outer cover 60 is formed by combining an outer front surface portion 63, an outer rear surface portion 64, an outer left side surface portion 65, an outer right side surface portion 66, and an outer upper surface portion 67, and each portion is formed by a panel-like cover member. The outer front surface portion 63 covers the front surface of the engine 22, and the outer rear surface portion 64 covers the rear surface of the engine 22. The outer left side surface portion 65 covers the left side surface of the engine 22, and the outer right side surface portion 66 covers the right side surface of the engine 22. The outer upper surface portion 67 covers the upper surface of the engine 22.

An edge 63*a* of the outer front surface portion 63, an edge 64*a* of the outer rear surface portion 64, an edge 65*a* of the outer left side surface portion 65, an edge 66*a* of the outer right side surface portion 66, and an edge 67*a* of the outer upper surface portion 67 are detachably attached to each other by a fixing structure (not shown), for example, an engaging structure or a fastening structure such as screw clamp.

The inner cover 70 is formed by combining an inner front surface portion 73, an inner rear surface portion 74, an inner left side surface portion 75, an inner right side surface portion 76, and an inner upper surface portion 77, and each portion is formed by a panel-like cover member. The inner front surface portion 73 is positioned between the outer front surface portion 63 and the front surface of the engine 22, and covers the front surface of the engine 22. The inner rear surface portion 74 is positioned between the outer rear surface portion 64 and the rear surface of the engine 22, and covers the rear surface of the engine 22. The inner left side surface portion 75 is positioned between the outer left side surface portion 65 and the left side surface of the engine 22, and covers the left side surface of the engine 22. The inner right surface portion 76 is positioned between the outer right surface portion 66 and the right side surface of the engine 22, and covers the right surface portion of the engine 22. The inner upper surface portion 77 is positioned between the outer upper surface portion 67 and the upper surface of the engine 22, and covers the upper surface of the engine 22.

An edge 73*a* of the inner front surface portion 73, an edge 74*a* of the inner rear surface portion 74, an edge 75*a* of the inner left side surface portion 75, an edge 76*a* of the inner right side surface portion 76, and an edge 77*a* of the inner upper surface portion 77 are detachably attached to each other by a fixing structure (not shown), for example, an engaging structure or a fastening structure such as screw clamp.

Openings 78 for maintenance of the engine 22 are formed in the inner left side surface portion 75 and the inner right side surface portion 76. Maintenance of the engine 22 can be performed through the openings 78 by detaching the outer cover 60. A space 68 between the inner rear surface portion 74 and the outer rear surface portion 64 forms a part of an intake air passage. A silencer 69 for reducing the air intake noise is formed on the inner rear surface portion 74.

An intake 1 for outer air is formed in the lower portion of the outer front surface portion 63, and a flow space SP for air taken in from the intake 1 is formed between the outer front surface portion 63 and the inner front surface portion 73. In the inner front surface portion 73, communication ports 2 and 3 are formed above the intake 1. The communication ports 2 and 3 are slit-like openings extending through the inner front surface portion 73 in the thickness direction, and make the internal space of the inner cover 70 accommodating the engine 22 communicate with the flow space SP.

Air taken in from the intake 1 is supplied to the engine 22 through the flow space SP and the communication ports 2 and 3, and used as air for cooling or air supply. For example, the air cools electric parts 22*a* such as an electronic circuit and a fuse box, accessories 22*b* such as an alternator, and accessories 22*c* such as a fuel paper filter, of the engine 22.

Since the intake 1 is formed in the outer front surface portion 63 forming the front surface of the outer cover 60, the navigation wind is easily taken in during navigation. It is also possible to prevent water from entering the engine 22 because the intake 1 is formed in the lower portion of the outer front surface portion 63, which is the upper portion of the stem of the ship hull Sh where water does not easily enter.

<Water Removing Structure>

Figure 3:
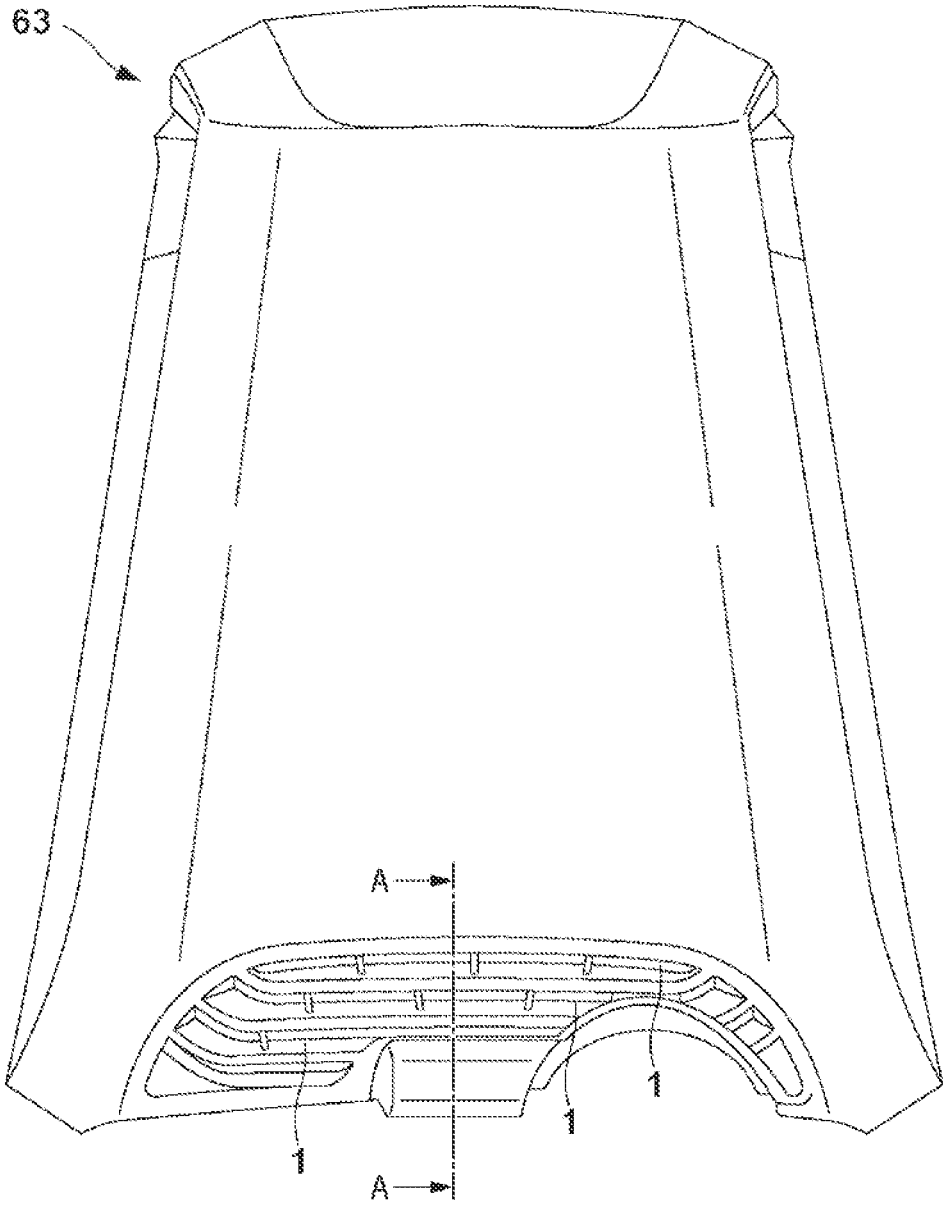
FIG. 3 is a front view of an upper cover.
Figure 4:
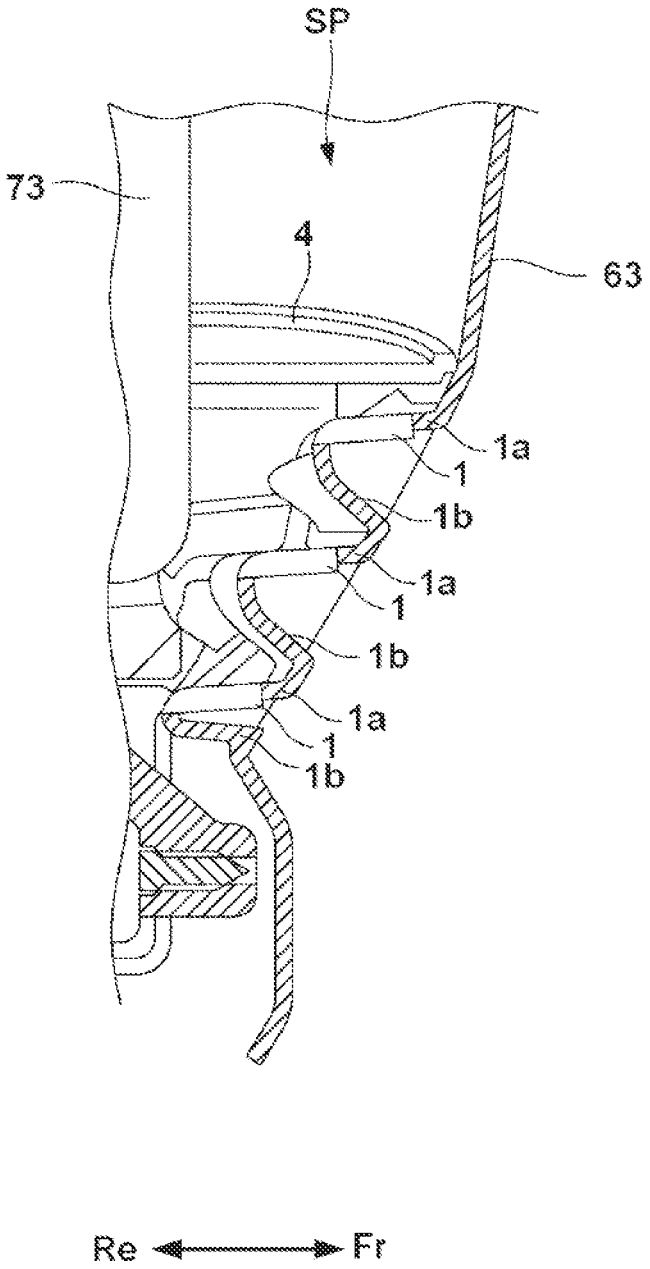
FIG. 4 is a sectional view taken along a line A-A in FIG. 3.
Figure 5:
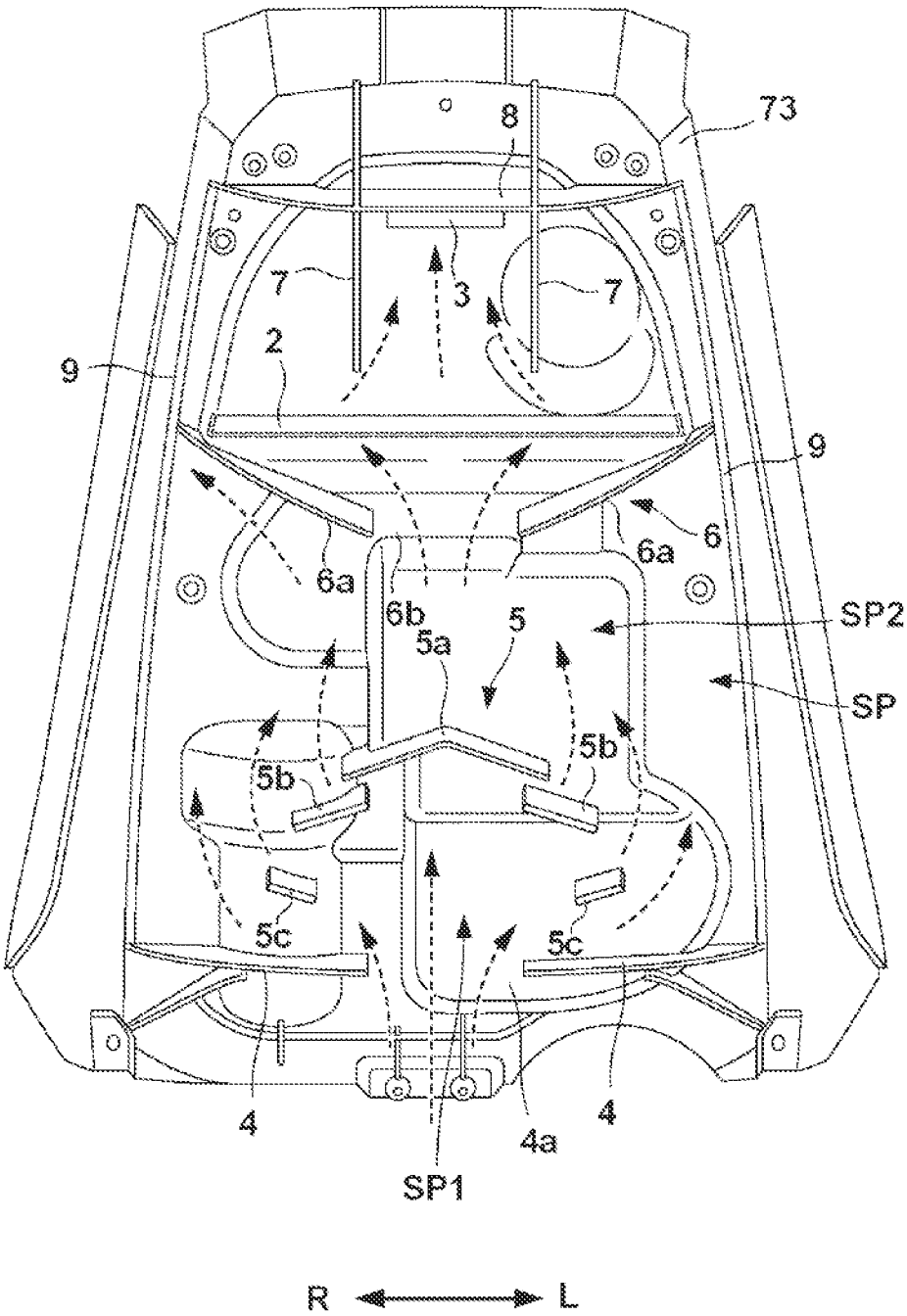
FIG. 5 is a front view of an inner front surface portion.

There is seawater or fresh water around the outboard engine 10, so air to be taken in from the intake 1 contains water. Arrival of this water at the engine 22 is undesirable from the viewpoints of rust and salt damage. This embodiment has a structure that effectively removes water in the flow space SP. This structure will be explained with reference to FIGS. 3 to 5. FIG. 3 is a front view of the upper cover 56, and is a view showing the upper cover 56 from the front side of the ship hull Sh. FIG. 4 is a sectional view taken along a line A-A in FIG. 3, and shows the structures of the outer front surface portion 63 and the inner front surface portion 73 around the intake 1. FIG. 5 is a front view of the inner front surface portion 73, and shows the internal structure of the flow space SP.

The intake 1 of this embodiment is a slit-like opening extending in the horizontal direction, and a plurality of intakes 1 are formed in the vertical direction. As is understood mainly from FIG. 4, the intakes 1 are formed in a wall portion 1*a* of the outer front surface portion 63. The wall portion 1*a* forms an L-shaped recess together with a wall portion 1*b* below the wall portion 1*a*. The wall portion 1*a* is an inclined wall whose front side is slightly higher than the horizontal level, and the intake 1 extends through the wall portion 1*a* in the thickness direction. Consequently, the intake 1 opens obliquely downward toward the front side (Fr) of the ship hull Sh, thereby preventing easy intrusion of water. Also, the wall portion 1*b* is an inclined wall that inclines downward from the rear (Re) side to the front side of the ship hull Sh, so the navigation wind taken in to the intake 1 easily hits the wall portion 1*b*. As a consequence, water of the navigation wind adheres to the wall portion 1*b*, and this suppresses the intrusion of water into the flow space SP.

The flow space SP is formed as a gap between the outer front surface portion 63 and the inner front surface portion 73. As mainly shown in FIG. 5, the inner front surface portion 73 has a pair of entrance ribs 4 projecting toward the outer front surface portion 63, a pair of side ribs 9, and an upper rib 8, and these ribs define the flow space SP. The pair of side ribs 9 are plate-like ribs extending in the vertical direction as they are spaced apart to the left and right. The upper rib 8 is a plate-like rib extending in the horizontal direction.

The pair of entrance ribs 4 are plate-like ribs extending in the horizontal direction and spaced apart to the left and right. A space between the pair of entrance ribs 4 forms an entrance 4*a* of the flow space SP. Air taken in from the intake 1 flows into the flow space SP through the entrance 4*a*. The width of the entrance 4*a* is made smaller than that of the intake 1, and the entrance 4*a* is positioned in a central portion of the flow space SP in the horizontal direction.

When air taken in from the intake 1 hits the entrance ribs 4, water of the navigation wind adheres to the entrance ribs 4, and this suppresses the intrusion of water into the flow space SP. In addition, since the entrance 4*a* is positioned in the central portion in the horizontal direction and so the navigation wind is guided to the central portion of the flow space SP in the horizontal direction, it is possible to control the flow of the navigation wind and make the wind hit lower ribs 5 (to be described later).

The communication ports 2 and 3 are formed in the inner front surface portion 73 in positions above the intake 1. In this embodiment, the communication ports 2 and 3 are formed in the upper portion of the inner front surface portion 73, and particularly the communication port 3 is formed in the uppermost portion of the flow space SP. Since the communication pots 2 and 3 are formed in the positions higher than the intake 1, it is possible to easily remove water from humid air rising in the flow space SP.

The communication port 2 is adjacent to the electric parts 22*a* and contributes to cooling of the electric parts 22*a*. The communication port 3 is adjacent to the accessories 22*b* and contributes to cooling of the accessories 22*b*. Since the communication ports 2 and 3 are formed, it is possible to reliably cool the respective target objects to be cooled.

Both the communication ports 2 and 3 are slit-like openings extending in the horizontal direction. However, the communication port 2 is a long opening traversing the flow space SP in the horizontal direction, whereas the communication port 3 is a short opening formed in only the central portion. Since the communication port 3 has a smaller opening area, it is possible to increase the flow velocity and enhance the effect of cooling the accessories 22*b*. Note that the two communication ports 2 and 3 are formed in this embodiment, but only one communication port may also be formed.

The inner front surface portion 73 has the lower ribs 5 and upper ribs 6 that resist air flowing from the intake 1 to the communication ports 2 and 3. The lower ribs 5 and the upper ribs 6 include a plurality of plate-like ribs projecting toward the outer front surface portion 63, and define the interior of the flow space SP. The lower ribs 5 are arranged between the intake 1 and the communication ports 2 and 3 in the flow space SP. The upper ribs 6 are arranged between the intake 1 and the communication portions 2 and 3 in the flow space SR and positioned closer to the communication ports 2 and 3 than the lower ribs 5. Air flowing from the intake 1 to the communication ports 2 and 3 is interfered twice by the lower ribs 5 and the upper ribs 6, and this increases the water removing efficiency.

The lower ribs 5 include a plurality of ribs 5*a* to 5*c* arrayed in the form of a mountain as a whole, and so arranged as to surround, together with the pair of entrance ribs 4, a lower portion SP1 in the central portion of the flow space SP in the horizontal direction. This makes it possible to more reliably cause air flowing into the lower portion SP1 to hit the lower ribs 5, thereby increasing the water removing efficiency.

The rib 5*a* is arranged in the central portion of the flow space SP in the horizontal direction, and is a mountain-shaped rib projecting upward. A pair of ribs 5*b* are medium ribs arranged below the rib 5*a* and spaced apart to the left and right. The pair of ribs 5*b* are plate-like ribs extending in the horizontal direction, and are inclined ribs that incline downward from the center to the outside in the horizontal direction. Each rib 5*b* is so arranged as to extend outside from the rib 5*a* in the horizontal direction.

A pair of ribs 5*c* are lower ribs arranged below the pair of ribs 5*b* and spaced apart to the left and right more than the pair of ribs 5*b*. The pair of ribs 5*c* are plate-like ribs extending in the horizontal direction, and are inclined ribs that incline upward from the center to the outside in the horizontal direction. Each rib 5*c* is so arranged as to extend outside from the rib 5*b* in the horizontal direction.

Since the pair of ribs 5*c* close to the entrance 4*a* are greatly spaced apart to the left and right, air flowing into the entrance 4*a* can be easily guided to the ribs 5*a* and 5*b*, thereby promoting the interference with the ribs 5*a* and 5*b*. In addition, since the pair of ribs 5*c* close to the entrance 4*a* incline upward from the central side to the outside of the horizontal direction, the water attached to the ribs 5*c* or dropping downward can be easily drained from the entrance 4*a*.

Since the pair of medium ribs 5*b* incline downward from the center to the outside in the horizontal direction, air flowing into the entrance 4*a* can easily be guided to the rib 5*a*, and this promotes the interference between the air and the rib 5*a*. Also, the upper rib 5*a* is arranged in the center in the horizontal direction and has a mountain-like shape. Since this prevents air flowing into the entrance 4*a* from directly flowing to the communication ports 2 and 3, the water removing efficiency can be improved.

The upper ribs 6 include a pair of ribs 6*a* spaced apart to the left and right. Air passing through the lower ribs 5 hits the pair of ribs 6*a*, so water is further removed. The air arrives at the communication ports 2 and 3 through a passage portion 6*b* between the pair of ribs 6*a*. The communication portion 6*b* functions as a throttle and increases the flow velocity of the air, so the air having a high flow velocity can be supplied to the engine 22 through the communication ports 2 and 3. This improves the cooling efficiency.

The passage portion 6*b* is positioned in the central portion of the flow space SP in the horizontal direction, and the pair of ribs 6*a* are plate-like ribs inclining from the central portion to the outside in the horizontal direction. This inclination of the pair of ribs 6*a* makes it possible to evenly supply air having passed the passage portion 6*b* to the communication ports 2 and 3.

The inner front surface portion 73 has plate-like ribs 7 extending in the vertical direction, on the left and right sides of the communication port 3. The ribs 7 can efficiently guide air to the communication port 3 having a small area.

The action of the water removing structure having the above configuration will be explained with reference to FIG. 5. The broken-line arrows shown in FIG. 5 schematically indicate the flows of air. Air taken in to the intake 1 flows into the flow space SP from the entrance 4*a*. During that time, water and the like are removed from the air by the interference with the wall portions 1*b* and the entrance ribs 4.

The air having passed the entrance 4*a* is first guided to the lower portion SP1. In this portion, the lower ribs 5 and the air interfere with each other, and water and the like are removed. Since the lower ribs 5 are formed as a group of a plurality of ribs, an air escape passage is secured, so a significant decrease in flow velocity can be prevented.

The air having passed the lower ribs 5 flows into a middle portion SP2. After that, the upper ribs 6 and the air interfere with each other, and water and the like are further removed. Since the upper ribs 6 are also formed as a group of a plurality of ribs, an air escape passage is secured, so a significant decrease in flow velocity can be prevented. Since the pair of ribs 6*a* are inclining, water attached to the ribs 6*a* falls down in the central portion of the flow space SR and the air having passed the passage portion 6*b* diffuses to the left and right.

The air having passed the upper ribs 6 enters the inner space of the inner cover 70 from the communication port 2 or 3, so the engine 22 can be cooled or intake air can be supplied.

In this embodiment as described above, the upper and lower ribs 5 and 6 remove water in two stages. This can increase the efficiency of removal, and can also prevent a large decrease in flow velocity.

Other Embodiments

The ribs are formed in the inner front surface portion 73 in the above embodiment, but all or some of the ribs may also be formed in the outer front surface portion 63. In addition, the intake 1 and the communication ports 2 and 3 are formed in the cover front surface portions (the inner front surface portion 73 and the outer front surface portion 63), but they may also be formed in another portion such as the cover side surface portions.

Summary of Embodiments

The above embodiments disclose at least the following cover structures.

1. A cover structure of the above embodiment is an outboard engine cover structure that covers an outboard engine (22) and includes an inner cover (70) on an inside and an outer cover (60) on an outside, comprising:

a flow space (SP) for air formed between the inner cover (70) and the outer cover (60);

an intake (1) formed in a lower portion of the outer cover (60) and configured to take in outer air to the flow space (SP);

a communication port (2, 3) formed in the inner cover (70) in a position above the intake (1), and configured to cause an inner space of the inner cover (70) accommodating the outboard engine (22) to communicate with the flow space (SP);

first ribs (5) arranged between the intake (1) and the communication port (2, 3) in the flow space (SP); and second ribs (6) arranged between the intake (1) and the communication port (2, 3) and positioned closer to the communication port (2, 3) than the first ribs (5) in the flow space (SP).

This embodiment can provide a technique capable of more effectively removing water and the like to be taken in to an outboard engine. Two-stage water removal by the first ribs and the second ribs can improve the efficiency of water removal without largely decreasing the flow velocity.

2. In the above embodiment, the inner cover (70) has an inner front surface portion (73) configured to cover a front surface of the outboard engine (22) when the outboard engine (22) is mounted on a ship hull (Sh), the outer cover (60) has an outer front surface portion (63) arranged to overlap the inner front surface portion (73), and configured to cover the front surface of the outboard engine (22), the flow space (SP) is formed between the inner front surface portion (73) and the outer front surface portion (63), the intake (1) is formed in the outer front surface portion (63), and the communication port (2, 3) is formed in the inner front surface portion (73).

This embodiment can efficiently take in the navigation wind.

3. In the above embodiment, the intake (1) opens obliquely downward toward a front side of the ship hull (Sh).

This embodiment can suppress the intrusion of seawater and fresh water.

4. In the above embodiment, the cover structure further comprises a pair of left and right entrance ribs (4) formed between the first ribs (5) and the intake (1), and configured to guide outer air taken in to the intake (1) to a central portion of the flow space (SP) in a horizontal direction.

This embodiment can control the flow of outer air to the central portion.

5. In the embodiment, the first ribs (5) are arranged to surround a lower portion (SP1) of the central portion of the flow space (SP) in the horizontal direction, together with the pair of left and right entrance ribs (4).

This embodiment can increase the efficiency of interference with the first ribs by guiding outer air to the lower portion.

6. In the above embodiment, the first ribs (5) include:

a mountain-shaped rib (5*a*) arranged in the central portion of the flow space in the horizontal direction and projecting upward;

a pair of medium ribs (5*b*) arranged below the mountain-shaped rib (5*a*) and spaced apart to left and right; and a pair of lower ribs (5*c*) arranged below the pair of medium ribs (5*b*) and spaced apart to left and right more than the pair of medium ribs (5*b*).

This embodiment can increase the efficiency of removal of water and the like and suppress a large decrease in flow velocity at the same time.

7. In the above embodiment, the second ribs (6) include a pair of ribs (6*a*) spaced apart to left and right.

This embodiment can increase the flow velocity by a throttle.

8. In the above embodiment, the communication port (2, 3) includes a first communication port (2), and a second communication port (3) formed above the first communication port (2), and ribs (7) extending in a vertical direction are formed on left and right sides of the second communication port (3).

This embodiment can allow air to easily flow into the second communication port.

9. In the above embodiment, the second communication port (3) has an opening area smaller than that of the first communication port (2).

This embodiment can increase the flow velocity of air passing through the second communication port.

The invention is not limited to the foregoing embodiments, and various variations/changes are possible within the spirit of the invention.

What is claimed is:

1. An outboard engine cover structure that covers an outboard engine and includes an inner cover on an inside and an outer cover on an outside, comprising:

a flow space for air formed between the inner cover and the outer cover;

an intake formed in a lower portion of the outer cover and configured to take in outer air to the flow space;

a communication port formed in the inner cover in a position above the intake, and configured to cause an inner space of the inner cover accommodating the outboard engine to communicate with the flow space;

first ribs arranged between the intake and the communication port in the flow space;

second ribs arranged between the intake and the communication port and positioned closer to the communication port than the first ribs in the flow space; and a pair of left and right entrance ribs formed between the first ribs and the intake, and configured to guide outer air taken in to the intake to a central portion of the flow space in a horizontal direction, wherein the inner cover has an inner front surface portion configured to cover a front surface of the outboard engine when the outboard engine is mounted on a ship hull, the outer cover has an outer front surface portion arranged to overlap the inner front surface portion, and configured to cover the front surface of the outboard engine, the flow space is formed between the inner front surface portion and the outer front surface portion, the intake is formed in the outer front surface portion, and the communication port is formed in the inner front surface portion.

2. The structure according to claim 1, wherein the intake opens obliquely downward toward a front side of the ship hull.

3. The structure according to claim 1, wherein the first ribs are arranged to surround a lower portion of the central portion of the flow space in the horizontal direction, together with the pair of left and right entrance ribs.

4. The structure according to claim 3, wherein the first ribs include:

a mountain-shaped rib arranged in the central portion of the flow space in the horizontal direction and projecting upward;

a pair of medium ribs arranged below the mountain-shaped rib and spaced apart to left and right; and a pair of lower ribs arranged below the pair of medium ribs and spaced apart to left and right more than the pair of medium ribs.

5. The structure according to claim 1, wherein the second ribs include a left side rib, and a right side rib spaced apart from the left side rib.

6. An outboard engine cover structure that covers an outboard engine and includes an inner cover on an inside and an outer cover on an outside, comprising:

a flow space for air formed between the inner cover and the outer cover;

an intake formed in a lower portion of the outer cover and configured to take in outer air to the flow space;

a communication port formed in the inner cover in a position above the intake, and configured to cause an inner space of the inner cover accommodating the outboard engine to communicate with the flow space;

first ribs arranged between the intake and the communication port in the flow space; and second ribs arranged between the intake and the communication port and positioned closer to the communication port than the first ribs in the flow space, wherein the inner cover has an inner front surface portion configured to cover a front surface of the outboard engine when the outboard engine is mounted on a ship hull, the outer cover has an outer front surface portion arranged to overlap the inner front surface portion, and configured to cover the front surface of the outboard engine, the flow space is formed between the inner front surface portion and the outer front surface portion, the intake is formed in the outer front surface portion, the communication port is formed in the inner front surface portion, the communication port includes a first communication port, and a second communication port formed above the first communication port, and the structure further comprises ribs, different from the first ribs and the second ribs, extending in a vertical direction and are formed on left and right sides of the second communication port.

7. The structure according to claim 6, wherein the second communication port has an opening area smaller than that of the first communication port.

* * * * *